US008459492B2

(12) United States Patent
Merino

(10) Patent No.: US 8,459,492 B2
(45) **Date of Patent: *Jun. 11, 2013**

(54) ICE TRAP FOR STRAW

(76) Inventor: Jaime Angel Merino, El Cajon, CA (US)

( * ) Notice: Subject to any disclaimer, the term of this patent is extended or adjusted under 35 U.S.C. 154(b) by 26 days.

This patent is subject to a terminal disclaimer.

(21) Appl. No.: 13/168,607

(22) Filed: Jun. 24, 2011

(65) Prior Publication Data

US 2012/0325835 A1 Dec. 27, 2012

(51) Int. Cl.
*A47G 19/22* (2006.01)
*B65D 83/00* (2006.01)

(52) U.S. Cl.
USPC ..... 220/705; 215/389

(58) Field of Classification Search
USPC ... 220/705, 703; 215/389, 388, 229; 210/467, 210/459; 239/33, 24
IPC ..... A47G 19/22
See application file for complete search history.

(56) References Cited

U.S. PATENT DOCUMENTS

| | | | | |
|---|---|---|---|---|
| 1,680,341 | A * | 8/1928 | Rosenthal | 215/11.1 |
| 1,847,879 | A | 1/1932 | Knecht | |
| 2,136,755 | A | 11/1938 | Prince | |
| 2,357,063 | A | 8/1944 | Swing | |
| 2,744,631 | A | 5/1956 | Toombs | |
| 2,753,050 | A | 7/1956 | Langston | |
| 3,099,565 | A * | 7/1963 | Neuhauser | 426/85 |
| 3,315,405 | A * | 4/1967 | Hoffer | 446/71 |
| 4,494,668 | A * | 1/1985 | Lottick | 220/709 |
| 4,938,375 | A | 7/1990 | Fantacone | |
| D332,548 | S * | 1/1993 | Mayatt | D7/300.2 |
| D345,889 | S | 4/1994 | Herricks | |
| 5,381,924 | A | 1/1995 | Kiefel | |
| 5,547,103 | A | 8/1996 | Murphy et al. | |
| 5,727,712 | A | 3/1998 | Costello | |
| 5,860,558 | A | 1/1999 | Fahy | |
| D407,944 | S | 4/1999 | Filbrun | |
| 5,971,202 | A | 10/1999 | Filbrun | |
| 7,337,705 | B1 * | 3/2008 | Catena et al. | 99/297 |
| 7,909,176 | B2 | 3/2011 | Merino | |
| 2004/0118769 | A1 * | 6/2004 | Merino | 210/459 |

* cited by examiner

*Primary Examiner* — Robert J Hicks
(74) *Attorney, Agent, or Firm* — George S. Levy

(57) ABSTRACT

This invention improves the cooling effect of ice in a drinking cup and economizes on the amount of ice used. The invention comprises a truncated cone with the widest base at the bottom, and with a hole at its apex, the hole being large enough to allow a straw to pass through. It also comprises a mechanism located at the apex of the cone, which holds the straw in place. This cone structure prevents ice cubes, which are normally buoyant, from floating up to the surface of the liquid. Instead, the cone forces the ice to congregate near the straw inlet thereby cooling the liquid entering the straw.

20 Claims, 17 Drawing Sheets

ICE TRAP FOR STRAW

INCORPORATION BY REFERENCE

U.S. Pat. No. 7,909,176 by Merino and U.S. patent application Ser. No. 12/869,731 also by Merino are thereby incorporated by reference.

FIELD OF THE INVENTION

The present invention relates to drinking cups and glasses containing iced beverages and more particularly to devices that can be mounted on a conventional drinking straw.

BACKGROUND

Adding ice to a drinking cup is very commonly performed in many fast food restaurants for the purpose of providing a cold drink to the customer. Since ice commonly floats to the surface of the drink and the straw intake located at the lower extremity of the straw is normally at the bottom of the cup, the liquid at the bottom near the straw intake is not as cold as it could be. One solution is to use a large amount of ice in proportion to the liquid in the cup. This approach has the unfortunate result of diluting the drink when the ice melts and of wasting ice. Existing art also has the disadvantage of keeping the ice dispersed in the liquid, rather than clumped together, thus hastening its melting.

Several approaches have been attempted to solve this problem by keeping the ice at the bottom of the cup. For example in U.S. Pat. No. 1,847,879 Knecht makes use of a perforated disk attached to the bottom of a straw to keep the ice down. Because of the buoyancy of the ice, this approach can only work with cylindrical glasses or cups and when the disk has essentially the same diameter as the cylinder. A smaller diameter or a conically shaped cup would allow the ice to creep around the disk and float up to the surface.

Another approach described in U.S. Pat. No. 4,938,375 by Fantacone describes a flexible ice trap in the shape of a net configured as an inverted cone (with the base on top) which holds the drinking straw in a hole located on the axis or the net. The net is designed to operate with a cup which is also conically inverted. The net "locks" in position in the cup as it is pushed downward. The problem with this approach is that the net is an inverted cone and therefore, the ice which is buoyant, congregates at its rim rather than at its center where the straw intake is located, thereby defeating the purpose of keeping the ice as close to the straw intake as possible. Furthermore, locking the straw in place may prevent the drinker from moving the ice trap around and capturing ice cubes underneath.

Yet another approach by Merino in U.S. Pat. No. 7,909,176 relies on a straw passing through a hole at the tips of an inverted conical net. Two washers are frictionally attached to the straw and are of a size larger than the inner diameter of the hole at the tip of the net, thereby holding the net in place between them. There are several problems with this approach: 1) The user must assemble the straw, washers and net; 2) even though the net is prevented by the washers from sliding along the axis of the straw, it can still yaw and pitch with respect to the straw; 3) washers can be difficult to attach and to slide along the straw without damaging the straw; and 4) loose parts can fall in the drink, thereby posing a danger.

Further features, aspects, and advantages of the present invention over the prior art will be more fully understood when considered with respect to the following detailed description and claims.

SUMMARY OF THE INVENTION

Figure 1:
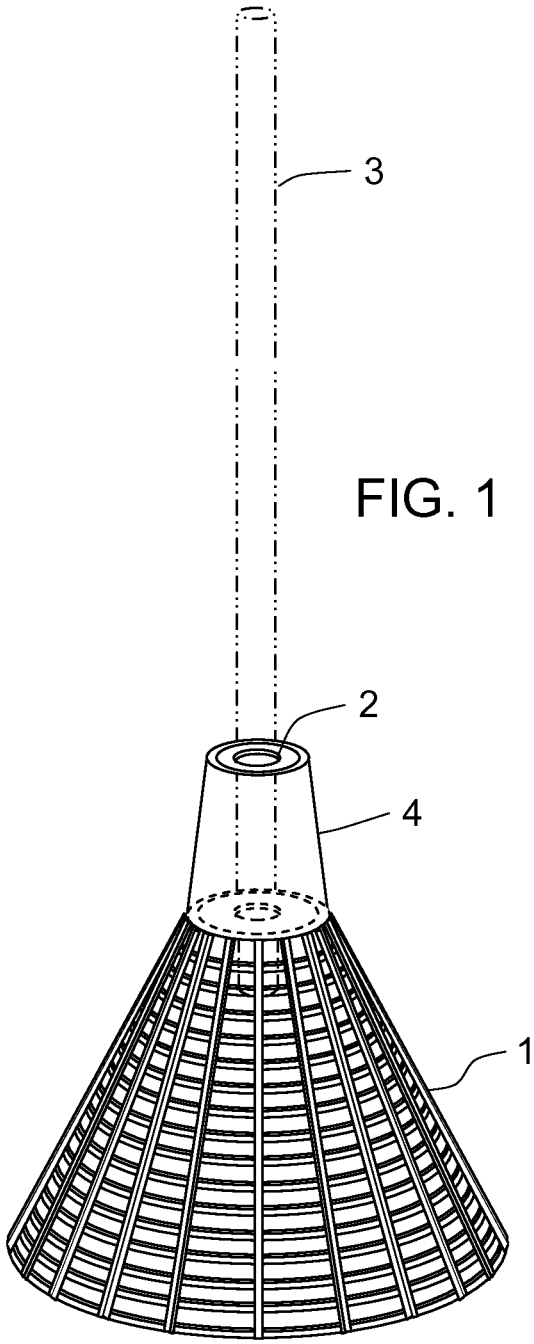
FIG. 1 illustrates the invention comprised of a mesh or net in the shape of an inverted cone and designed to hold a straw through its apex.

The purpose of this invention is to maximize the cooling effect of ice on the liquid held in a drinking cup and to economize on the amount of ice used. The invented device comprises a truncated cone comprised of a net or mesh or solid sheet, with the widest base at the bottom. The apex of the cone is traversed by a hole through which a straw can pass. This cone structure prevents ice, which are normally buoyant, from floating up to the surface of the liquid. Instead, the cone forces the ice cubes to congregate near the straw inlet thereby cooling the liquid entering the straw.

The invention comprises the following:

1. a cone in the shape of a truncated cone with a hole at its apex, large enough to allow a straw to pass through;
2. a mechanism located at the apex of the cone that holds the straw in place. The straw is prevented from sliding along the axis of the cone by frictional or mechanical means.

The retaining force exerted by the holding mechanism is adjusted to be weak enough to allow a user to push a conventional straw through the hole in the cone, yet large enough to prevent the cone from being pushed upward by the buoyancy of the ice after the straw has been inserted through the hole and is held stationary. Optionally the straw is also prevented by mechanical means from yawing or pitching with respect to the axis of the cone.

The attachment mechanism for the straw can be implemented in several possible ways. In one particular embodiment it comprises at least one rubber-like disk shaped membrane perforated by a hole configured to fit snugly around said straw and providing a resistive frictional force against sliding movement of the straw.

In another embodiment the disk-shaped membrane is replaced by a funnel-shaped membrane that holds the straw at the narrow end of the funnel.

In yet another embodiment, the disk-shaped membrane is slit radially into multiple sectors and the sectors flex when the straw is pushed through, thereby holding the straw in place.

In one more embodiment, the retaining structure is a tube narrowed at its waist, the narrowing configured to fit snugly around the straw. More than one narrowing is possible.

Another embodiment makes use of a retaining tube in which tabs have been scored and pushed in, resulting in a narrow passage that holds the straw in place.

Yet another embodiment makes use of truncated restraining cones that form a narrow passage configured to exert a constricting and restraining force on the straw.

One more embodiment utilizes a flexible oval tube that restricts the sliding of the straw when the tube is not squeezed and does not restrict the straw when it is squeezed. The inside of the oval tube can be coated in part or in whole with material selected for its high friction coefficient.

Yet another embodiment comprises a straw permanently attached to the cone at the apex of the cone. The straw can be either cylindrical or conical to facilitate the stacking of the device.

One more embodiment makes use of specially designed straws. For example the straw could have at its lower end annular protuberances forming a neck. The attachment mechanism on the cone could operate as a collar holding the straw in place. Another example involves the straw having a single annular protuberance and the attachment mechanism on the cone shaped as a tube with a swelling at its waist allowing the straw to snap and be held into place. Another example requires a single annular protuberance near the lower end of the straw and a conical flaring structure at the end of the straw. The attachment mechanism is shaped as a collar and holds the straw in place.

A method of forming the cone is also presented that includes cutting a sheet into an open ring, cutting slits into the inside edge of the ring and joining the end of the ring together to form a truncated cone.

DETAILED DESCRIPTION

This invention is a cone structure affixed at the bottom end of a straw designed to hold down and gather ice cubes near the liquid intake of a straw for the purpose of achieving a cooler temperature of the aspirated liquid and a greater economy of ice. It comprises:

a. a truncated cone made up a net, a mesh or a solid sheet and having its base at the lower end and its apex at the top end,
b. the apex is traversed by a hole through which a straw can pass,
c. furthermore, the apex also comprises an attachment mechanism for affixing a straw, the attachment mechanism being non-detachable from the apex;

This cone operates by directing the ice cubes toward the axis of the cone and toward the bottom opening of the straw.

An embodiment of the invention is illustrated in FIG. 1. It comprises a cone and positioned such that the base of the cone is at the bottom, and the apex of the cone is at the top. The apex is truncated to include a hole 2 large enough to allow a straw 3 to pass through and also comprises a mechanism 4 that holds the straw in place.

Figure 2:
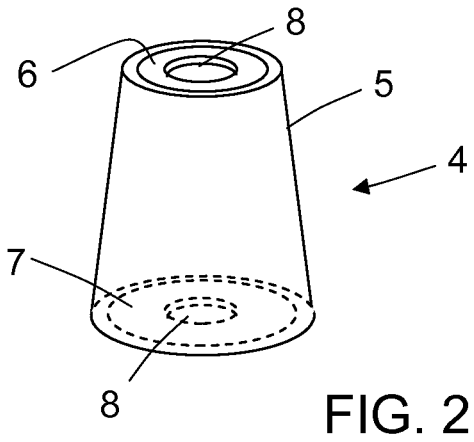
FIG. 2 shows the straw holding mechanism in perspective view. This mechanism utilizes two perforated membranes made of elastic and high friction and elastic material such as rubber that hold the straw passing through their perforations.
Figure 2A:
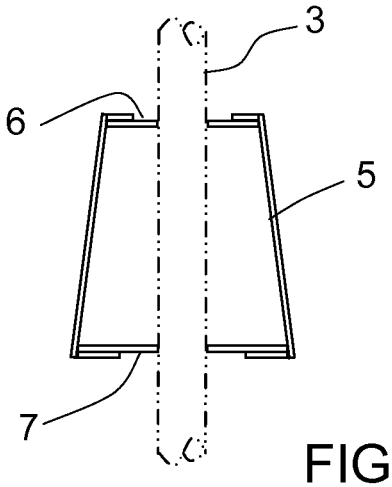
FIG. 2A provides a cross-sectional view of the straw holding mechanism of FIG. 2.

FIG. 2 provides a detailed perspective view of this straw holding mechanism 4 and FIG. 2A, a detailed cross-sectional view. In this embodiment, the straw holding mechanism 4 comprises a conical cylinder 5 carrying at its two ends, perforated membranes or sheets 6 and 7 made of a flexible material such as rubber. The holes 8 in the sheets are slightly smaller than the diameter of the straw 3 and configured to fit snugly around the straw, thereby providing enough resistive frictional force to prevent the straw 3 from sliding along the axis of the cone 1. The diameter of the holes 8 is adjusted to generate a force weak enough to allow a customer to push a conventional straw 3 through the holes, yet large enough to prevent the cone from being pushed upward by the buoyancy of the ice after the straw 3 has been inserted through the holes 8 and is held stationary.

Figure 3:
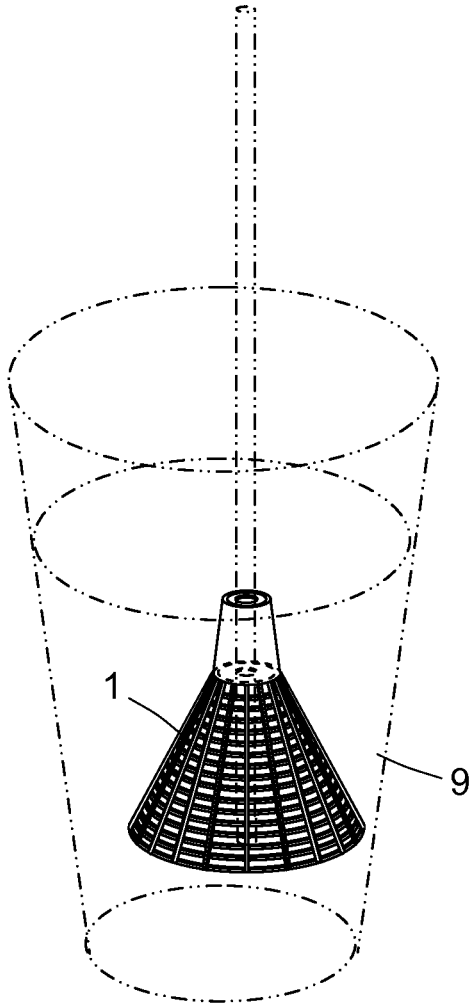
FIG. 3 illustrates the use of the invention in a drinking cup.
Figure 3A:
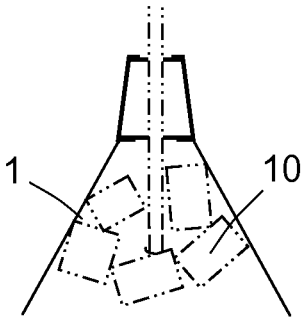
FIG. 3A shows how the ice is trapped beneath the conically shaped net.

FIGS. 3 and 3A illustrate the operation of this embodiment. FIG. 3 shows how the device is positioned in a glass 9 containing liquid. FIG. 3A show how the cone structure of the cone 1 prevents ice cubes 10, which are normally buoyant, from floating up to the surface of the liquid. Instead, the cone 1 forces the ice cubes 10 to congregate near the inlet of the straw 3 inlet thereby cooling the liquid entering the straw 3.

Figure 4:
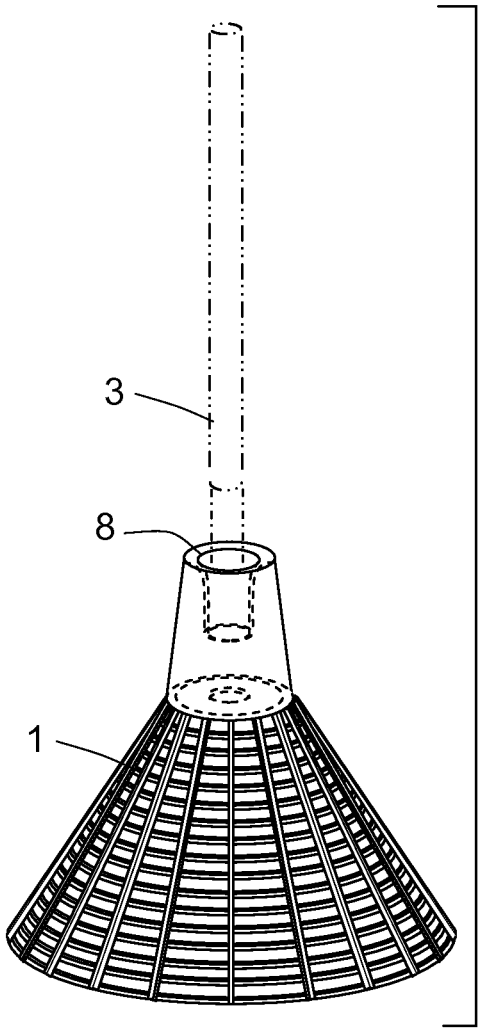
FIG. 4 illustrates a variation of the invention in which the retaining membrane is shaped as a funnel to decrease friction when the straw slides down with respect to the net and increase friction when the straw slides up.
Figure 4A:
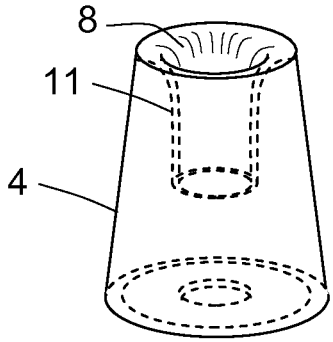
FIG. 4A provides a detailed perspective view of the straw holding mechanism shown in FIG. 4.
Figure 4B:
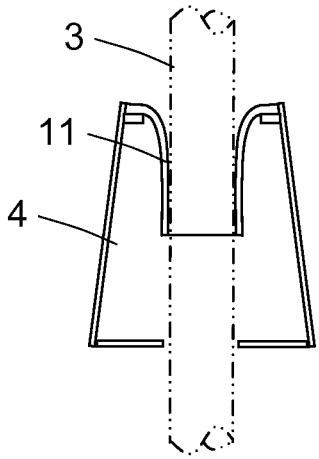
FIG. 4B provides a detailed cross-sectional view of the straw holding mechanism shown in FIG. 4.

Many possible variations exist on this basic theme. FIG. 4 shows how the rubber membrane can be shaped as a funnel 11. The lower end of the funnel is configured to fit snugly around the straw. It operates by decreasing friction when the cone 1 slides down the straw 3 and increasing friction when the cone 1 slides up the straw 3. FIG. 4 illustrates how the straw 3 is inserted by the user by sliding it into the hole 8 at the top of the cone 1. FIG. 4A provides a perspective illustration of the straw holding mechanism showing the membrane. FIG. 4B provides a cross-sectional image of this holding mechanism.

Figure 5:
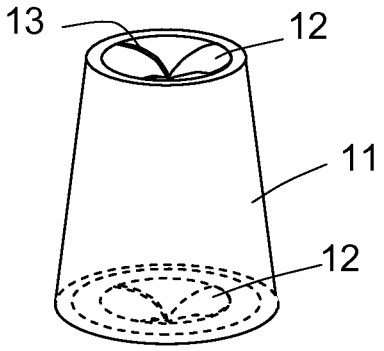
FIG. 5 illustrates a holding mechanism in perspective, making use of a plastic plate divided into multiple sectors. The retaining force between the straw and the net is produced by the sectors bent downward and exerting a constricting force on the straw.
Figure 5A:
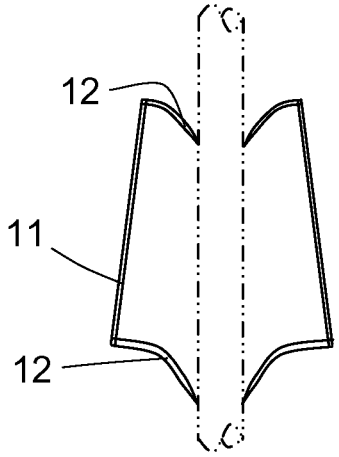
FIG. 5A is a cross-sectional view of the example shown in FIG. 5.

FIG. 5 illustrates in perspective view a possible variation in the straw holding mechanism, and FIG. 5A shows the same variation in cross-sectional view. The mechanism comprises a conical cylinder 11 carrying circular plastic plates 12 on it top and bottom. The plastic plates 12 are divided into sector by a number of radial slits 13. As the straw 3 is inserted from the top, the tip of each sectors bends down, exercising a force on the straw 3 and providing the resistance required to prevent the straw 3 from sliding along the axial direction. The thickness and type of material of the circular plastic plates is selected to allow a user to insert a straw from the top, yet resistant enough to prevent the buoyancy of the ice from sliding the cone 1 up the straw 3.

Figure 5B:
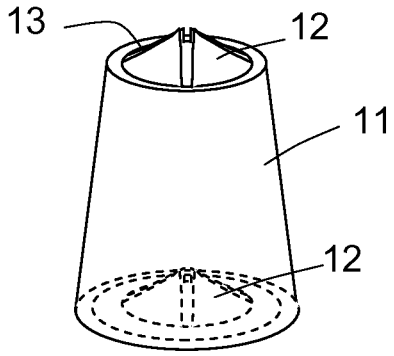
FIG. 5B illustrates a holding mechanism in perspective, making use of a plastic plate divided into multiple sectors. The retaining force between the straw and the net is produced by the sectors bent upward and exerting a constricting force on the straw.
Figure 5C:
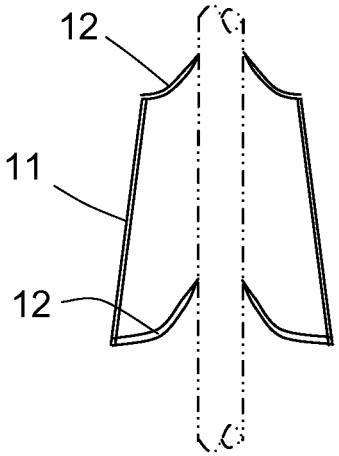
FIG. 5C is a cross-sectional view of the example shown in FIG. 5B.

Another variation shown in FIGS. 5B and 5C is almost identical to the previous one (FIGS. 5A and 5B) except that the straw 3 is inserted from the bottom of the cone 1 and the sectors are designed to bend upwards. This particular geometry is interesting because of the unequal friction generated by the upward and downward sliding motion of the cone 1 with respect to the straw 3. If the cone 1 is pushed upward with respect to the straw 3, the sectors are forced downward and inward, thereby increasing the constricting force exerted by the sectors on the straw 3. Conversely, if the cone 1 is pushed downward, the sectors are forced upward and outward, thereby decreasing the constricting force exerted by the sectors on the straw 3. The result is a decreased resistance to the downward slide of the cone 1 and an increased resistance to the upward slide. This is the characteristic required to counter the buoyancy of the ice yet make it easy to insert the straw 3 through the bottom of the cone 1.

Figure 6:
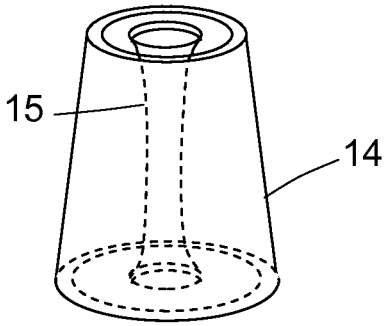
FIG. 6 illustrates a holding mechanism comprised of a tube narrowed at one place at its waist that exerts a constricting force on the straw.
Figure 6B:
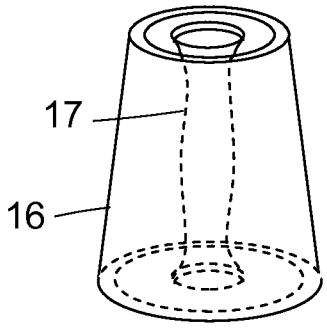
FIG. 6B illustrates a holding mechanism comprised of a tube narrowed at two places at its waist that exerts a constricting force on the straw. This two-place constriction restricts the straw from moving in pitch and yaw with respect to the net.
Figure 6A:
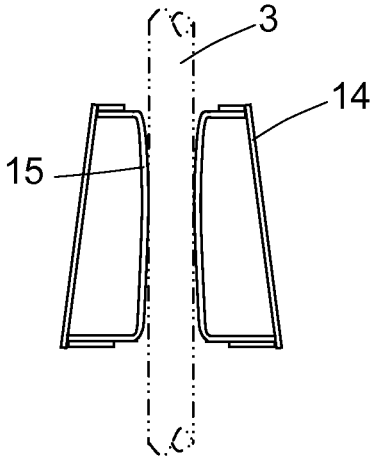
FIG. 6A is a cross-sectional view of the example shown in FIG. 6.

Yet another variation is illustrated in FIG. 6 in perspective view and in FIG. 6A in cross-sectional view. The straw holding mechanism 14 is a conical cylinder carrying on its axis a smaller, coaxial tube 15 made of flexible material and essentially cylindrical but narrowed at its waist and configured to fit snugly around the straw. When a straw 3 is inserted, the tube 15 widens but still exerts on the straw 3 a constrictive force, thereby increasing the friction between the straw 3 and the cone 1.

Figure 6C:
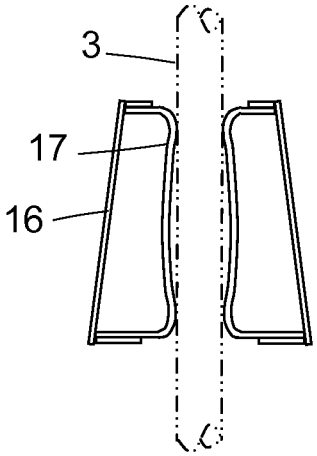
FIG. 6C is a cross-sectional view of the example shown in FIG. 6B.

Yet one more variation illustrated in FIG. 6B in perspective view and in FIG. 6C in cross-sectional view is almost identical to the one shown in FIGS. 6 and 6A except that the straw holding mechanism 16 contains a coaxial tube 17 which is narrowed at two places rather than at a single place, thereby providing the straw 3 with support in the yaw and pitch direction with respect to the axis of the cone 1.

Figure 7:
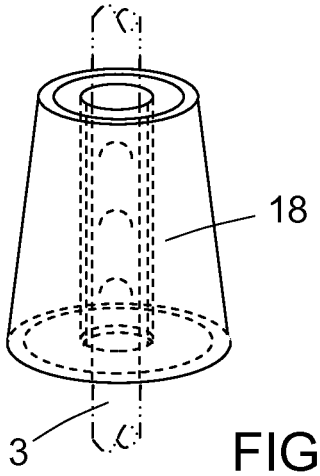
FIG. 7 illustrates in perspective a holding mechanism which makes use of a tube in which a number of punched in semi-circular tabs make contact with the straw.
Figure 7A:
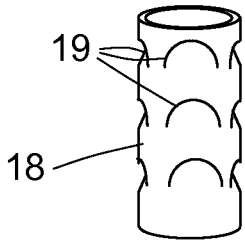
FIG. 7A shows the tube with the punched-in semi-circular tabs of FIG. 7.
Figure 7B:
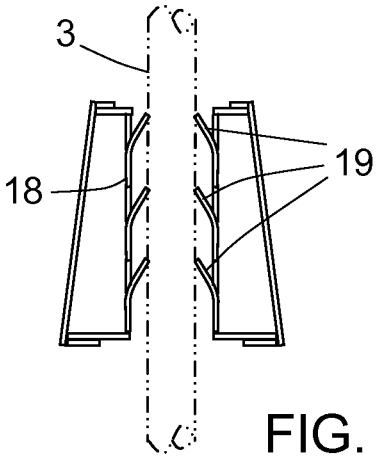
FIG. 7B provides a cross-sectional view of the holding mechanism of FIG. 7.

FIGS. 7, 7A and 7B illustrate another variation in which the straw holding mechanism comprises a cylindrical cone coaxial with a smaller tube 18 into which a number of semicircular tabs 19 have been cut and punched in allowing them to make forceful contact with the straw 3. FIG. 7 shows the mechanism in perspective view, FIG. 7A shows the inner tube 18 and FIG. 7B illustrates the mechanism in cross-section. As the cone 1 slides downward with respect to the straw 3, the tabs are bent down and inward thereby increasing the constriction force around the straw 3 and increasing friction in a fashion already described in the context of FIGS. 5B and 5C.

Figure 8:
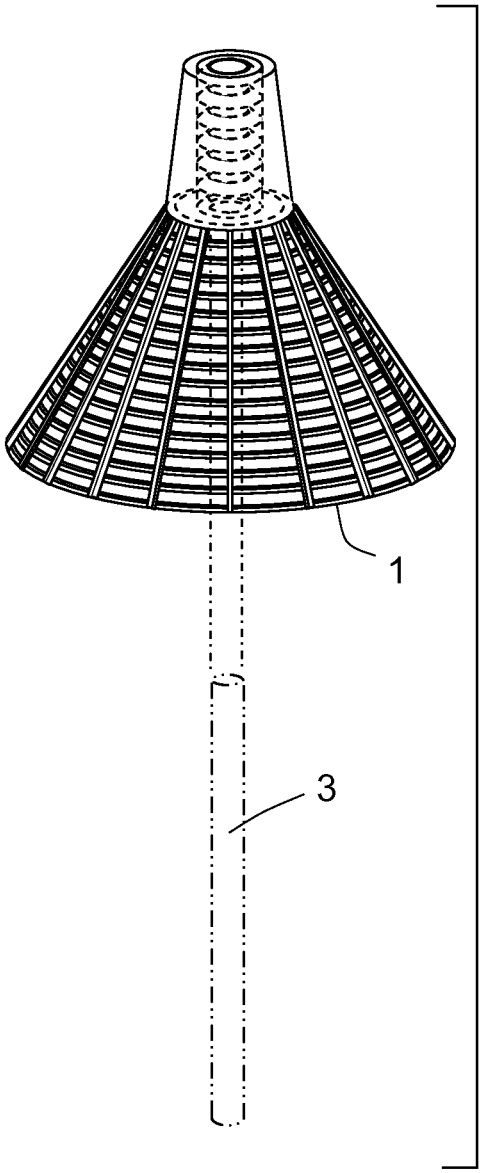
FIG. 8 illustrates in perspective a holding mechanism which makes use of a tube lined in its inside with truncated conical plates which exert on the straw a greater retaining force when the straw slides up with respect to the net and weaker when it slides down.
Figure 8A:
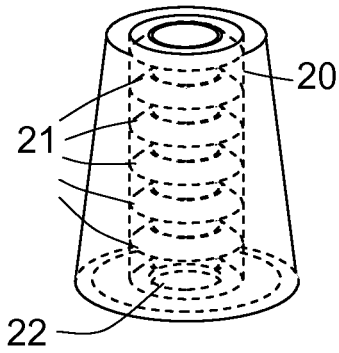
FIG. 8A shows a detailed perspective view of the holding mechanism of FIG. 8.
Figure 8B:
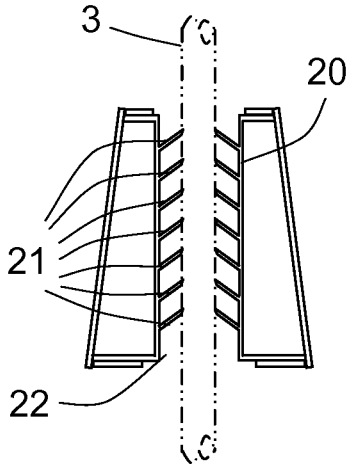
FIG. 8B provides a cross-sectional view of the holding mechanism of FIG. 8A.

FIGS. 8, 8A and 8B show a variation in which the straw holder mechanism comprises a tube 20 lined on its inside with a series of coaxial truncated cones 21, each truncated cone 21 oriented to have its apex on top and its base at the bottom. FIG. 8 shows the straw 3 being inserted through the bottom of the cone 1, FIG. 8A provides a perspective view of the straw 3 holding mechanism and FIG. 8B provides a cross-sectional view of this mechanism. The base of each truncated cone 21 has its diameter large enough to make contact with the inside surface of the tube 20. The apex of each cone 21 is configured with a hole slightly smaller than the diameter of the straw 3 so as to achieve a snug fit when the straw 3 is inserted into the hole 22. The narrow openings of the restraining cones forms a narrow passage configured to exert a constricting force on the straw, thereby restricting the sliding of the straw along the axis of the cone. This particular geometry ensures that when the cone 1 is slid down the straw 3, friction is minimized thereby facilitating the insertion of the straw 3 through the bottom of the cone 1, and when the cone 1 is slid up the straw 3, friction is maximized, thereby countering the buoyancy of the ice.

Figure 9:
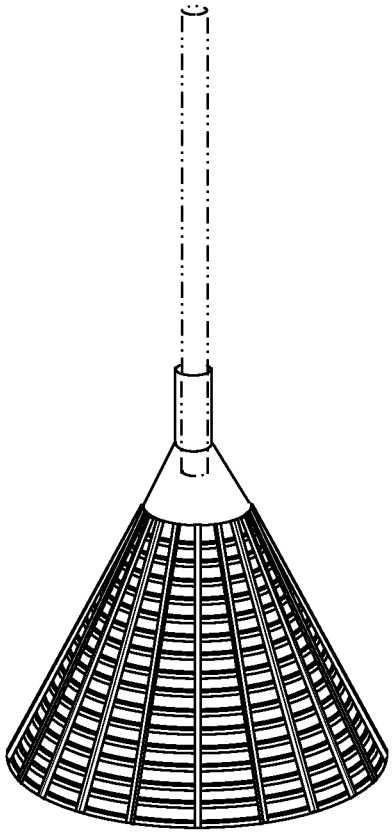
FIG. 9 shows a holding mechanism that makes use of an oval tube lined with a high friction material. The tube is opened by squeezing the oval in the direction of its major axis and closed by releasing it.
Figure 9A:
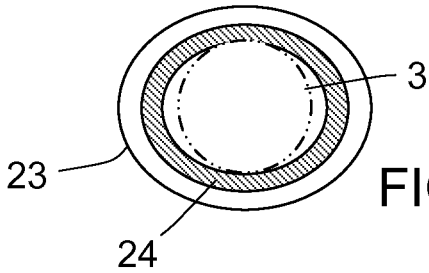
FIG. 9A shows the holding mechanism of FIG. 9, in cross section and in its relaxed closed mode. In this version the high friction material coats the inside of the oval tube uniformly.
Figure 9B:
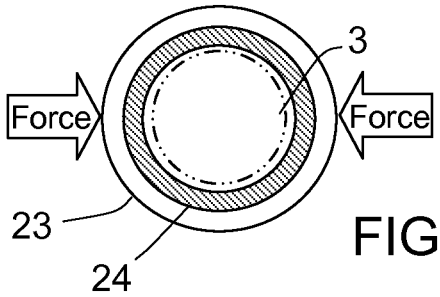
FIG. 9B shows the holding mechanism of FIG. 9, in cross section and in its squeezed open mode. In this version the high friction material coats the inside of the oval tube uniformly.
Figure 9C:
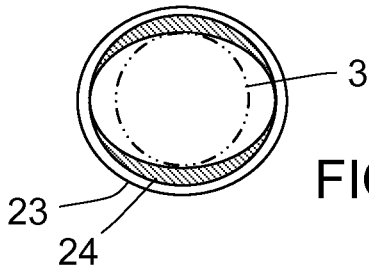
FIG. 9C shows the holding mechanism of FIG. 9, in cross section and in its relaxed closed mode. In this version the high friction material coats the inside of the oval tube mainly in the area making contact with the straw.
Figure 9D:
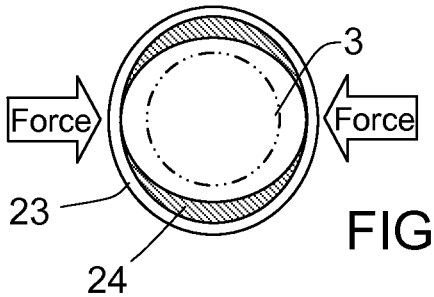
FIG. 9D shows the holding mechanism of FIG. 9, in cross section and in its squeezed open mode. In this version the high friction material coats the inside of the oval tube mainly in the area making contact with the straw.

FIGS. 9 through 9B illustrate a variation in which the cone 1 terminated at its apex by a tube 23 lined on the inside with a high friction material 24 such as rubber. This tube has normally an elliptical cross-section such that, on the inside, the major axis of the ellipse is larger than the outer diameter of the straw 3 and the minor axis is slightly smaller than the outer diameter of the straw 3. When the tube 23 is squeezed along the major axis it becomes circular in cross-section, as shown in FIGS. 9B and 9D, allowing the straw 3 to slide easily through it. When the tube 23 is released, it resumes its elliptical shape as shown in FIGS. 9A and 9C, thereby holding the straw 3 in place. The high friction lining 24 can be uniformly distributed around the inside of the tube 23 as shown in FIGS. 9A and 9B or it can be applied only in areas making contact with the straw 3 as shown in FIGS. 9C and 9D.

Figure 10:
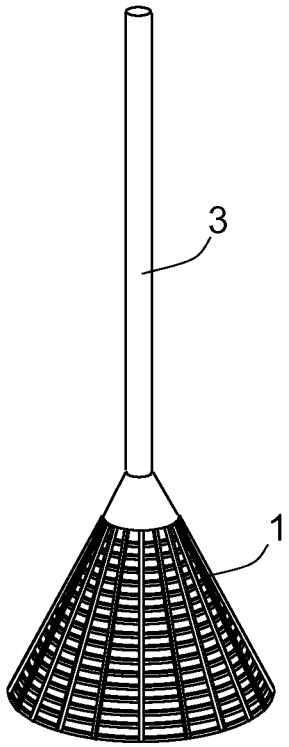
FIG. 10 illustrates a version of the invention in which the straw is permanently attached to the net.

Yet another variation shown in FIG. 10 involves a cone 1 truncated and configured with a hole at its apex, and firmly attached to a straw 3 passing through the hole. This design has the advantage of not requiring assembly of the cone and the straw by the user.

Figure 10A:
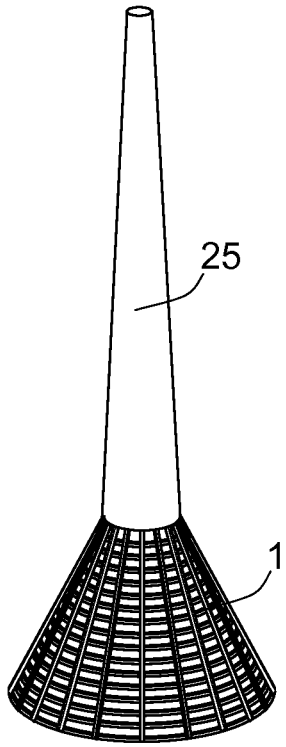
FIG. 10A illustrates a version of the invention in which the straw is permanently attached to the net. In addition the straw has a conical shape to facilitate storage and stacking.

A variation on the theme presented in FIG. 10 is shown in FIG. 10A in which the straw 25 is in the shape of a slender truncated cone, with the wide base of the slender cone firmly attached to the apex of the cone 1, thereby allowing for easier stacking and storage of the device.

Figure 11:
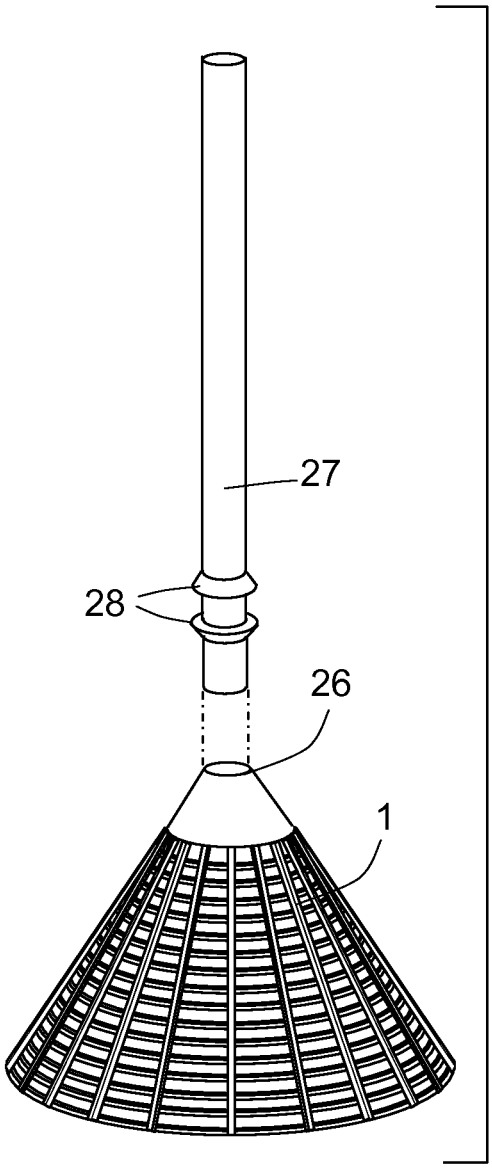
FIG. 11 show a variation of the invention in which the straw carries two permanently attached annular protuberances near its lower end, each protuberance having a saw-tooth cross-section.
Figure 11A:
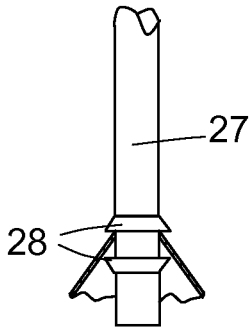
FIG. 11A provides a detailed cross-sectional view of the holding mechanism shown in FIG. 11.

Variations presented in FIGS. 11-13A requires the utilization of non-standard straws. In FIG. 11 the cone 1 is truncated at its apex and configured with a hole 26 essentially of the same size as the straw diameter. The straw 27 is shown equipped near its lower end, with two annular protuberances 28, each protuberance being permanently attached, going around the periphery of the straw 27 and having the cross-sectional shape of a saw tooth. The protuberances are permanently attached to the straw form between themselves a narrow neck along the straw. The attachment mechanism is in the shape of a collar, and is configured to fit snugly around the neck when the lower end of the straw is pushed through the collar, thereby holding the straw in place. The saw teeth are oriented such that the vertical sides of the saw teeth face each other. As the straw 27 is pushed down into the hole 26 at the top of the cone 1, the lowest of the two protuberances 28 penetrates the hole 26 and the cone 1 becomes caught and is firmly held between the two protuberances 28 as illustrated in FIG. 11A.

Figure 12:
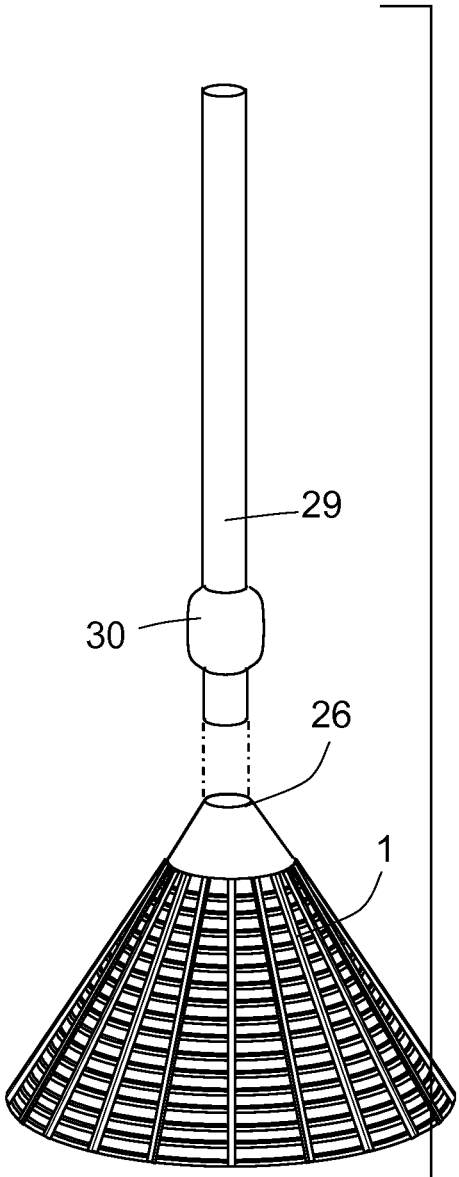
FIG. 12 show a variation of the invention in which the straw carries a single permanently attached annular protuberance near its lower end. In addition, the apex in the net is configured with a receiving chamber that fits around and holds the protuberance on the straw.
Figure 12A:
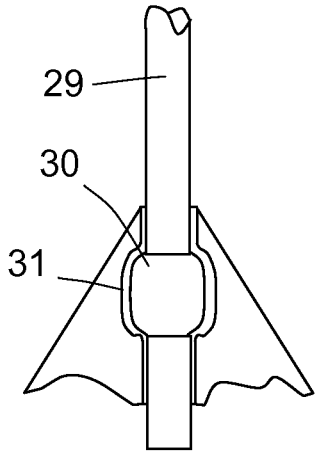
FIG. 12A provides a detailed cross-sectional view of the holding mechanism shown in FIG. 12.

In the variation shown in FIG. 12 the straw 29 carries an annular protuberance 30 near its lower end. The hole 26 traversing the apex of the cone widens forming a chamber 31 essentially having the same shape as the straw with the protuberance. When the straw 29 is pushed down into the hole 26, the protuberance 30 snaps into the chamber 31 as shown in FIG. 12A, thereby holding the straw 29 in place.

Figure 13:
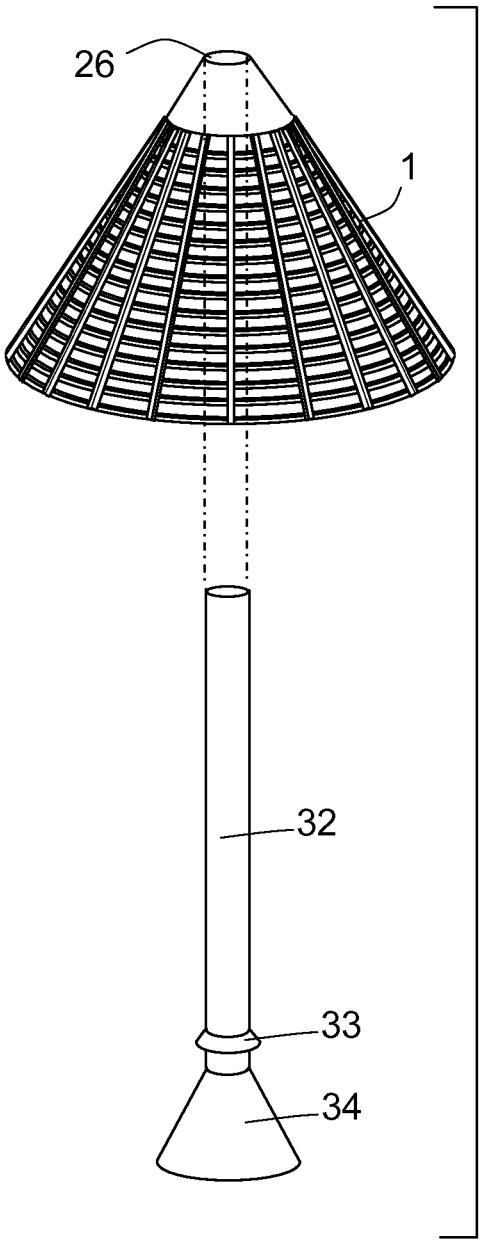
FIG. 13 provides an exploded view for a variation of the invention in which the straw carries a single permanently attached annular protuberance in the shape of a saw tooth near its lower end and a conical flair at the lower end.
Figure 13A:
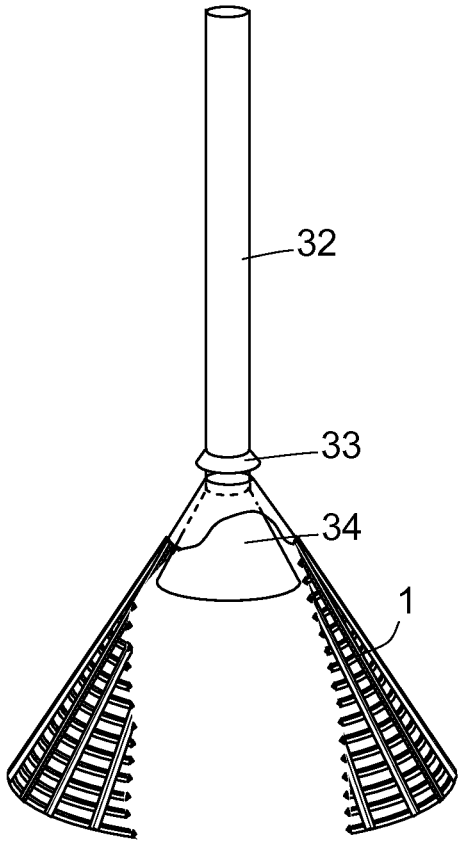
FIG. 13A provides a cut-out view of the variation shown in FIG. 13, showing how the conical flair fits within the net.

The variation shown in FIG. 13 requires a straw 32 equipped with an annular protuberance 33 having a saw tooth cross-section located near its lower end. In addition the lower end flares up in a conical structure 34 matching the angle of the cone 1. The straw 32 is inserted through the bottom of the cone 1. After the saw tooth protuberance 33 is forced through the hole 26 at the apex of the cone, this protuberance 33 and the cone structure 34 at the bottom of the straw 32 hold the cone 1 firmly in place as shown in FIG. 13A.

Figure 14:
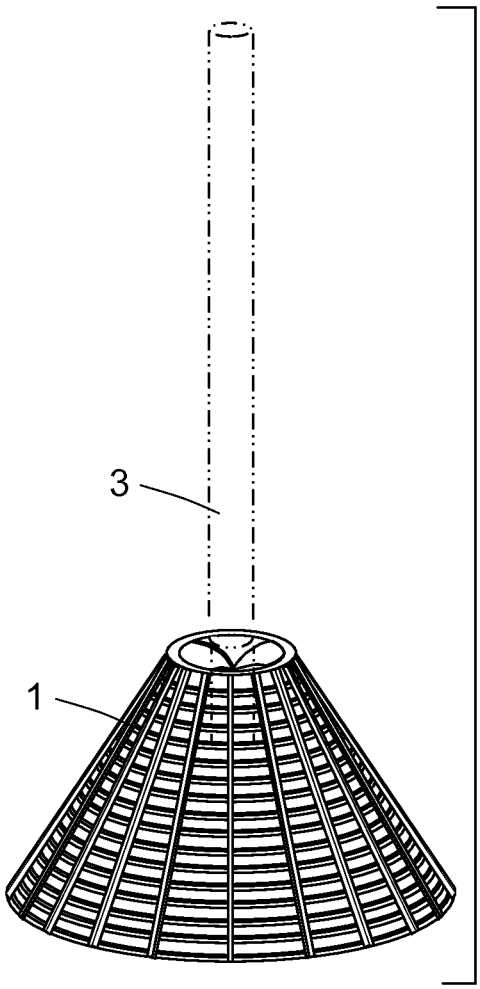
FIG. 14 shows a variation which is easily stackable comprising an attachment mechanism made of a single disk divided into a number of sectors by slits.
Figure 14A:
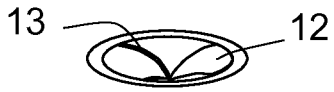
FIG. 14A provides a detailed view of the disk with slits shown in FIG. 14.
Figure 14B:
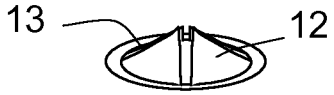
FIG. 14B shows how the sectors forming the attachment disk can be bent upward thus providing a better restraining performance for the straw.
Figure 14C:
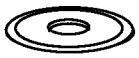
FIG. 14C illustrates an attachment mechanism comprised of a single rubber ring configured to fit snugly around the straw.

The variations shown in FIGS. 14 to 14C have the advantage of being easily stackable. FIG. 14 illustrates an attachment mechanism made of a single disk divided into a number of sectors 12 by slits 13. As the straw 3 is pushed down into the cone 1, the sectors 12 bend down and exert a constrictive and restraining force on the straw 3 that prevents the straw 3 from sliding along the axis of the cone 1.

FIG. 14A provides a detailed view of the attachment mechanism of FIG. 14.

FIG. 14B shows how the sectors forming the attachment disk can bent upward when the straw is inserted through the bottom of the cone, thus providing a better restraining performance for the straw. Friction is greater when the cone slides up the straw than when it slides down.

FIG. 14 C illustrates an attachment mechanism comprised of a single ring fitting tightly around the straw. This ring could be made of plastic like the cone or of a material such as rubber.

Figure 15:
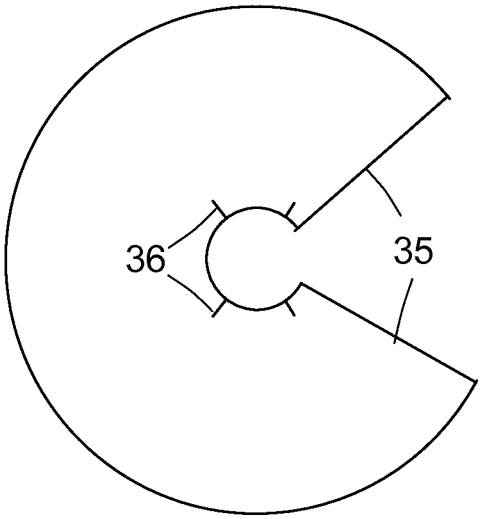
FIG. 15 shows the shape of a starting sheet used to form a cone.
Figure 15B:
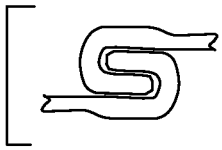
FIG. 15B shows a possible attachment mechanism that holds together the edges of the sheet forming the cone. This mechanism makes use of interlocking folds shaped along the edge of the sheet.
Figure 15A:
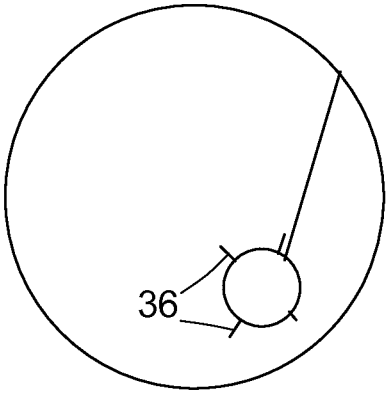
FIG. 15A illustrates the cone that results obtained when the edges of the sheet in FIG. 15 are brought together.
Figure 15C:
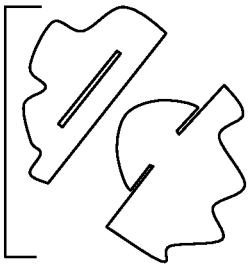
FIG. 15C shows another possible attachment mechanism that holds together the edges of the sheet forming the cone. This mechanism makes use of a hole configured near one edge and a mating arrow configured on the opposite edge.

FIGS. 15, 15A, 15B and 15C describes a possible method for constructing the cone. A sheet is cut as shown in FIG. 15. The sheet can be perforated to make a net or can be solid. The sheet is then curled as shown in FIG. 15A and the edges 35 can be joined together using an attachment mechanism such as shown in FIGS. 15B and 15C. The sheet at the tip of the cone is cut into a number of slits 36 to form an attachment mechanism for the straw.

Figure 16:
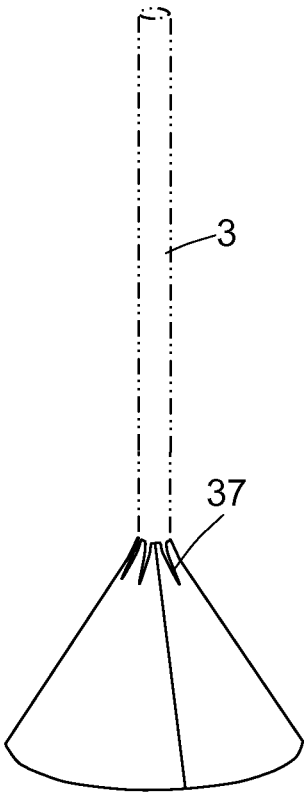
FIG. 16 shows the finished product obtained when a solid sheet is used to fabricate the cone.
Figure 16A:
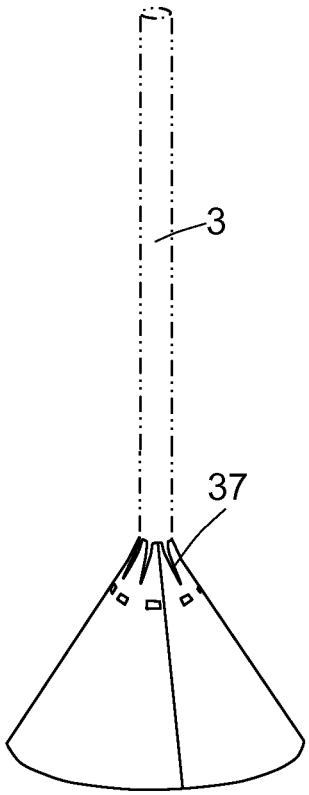
FIG. 16A shows the finished product obtained when a mostly solid sheet is used to fabricate the cone. A few holes are configured near the top of the cone.
Figure 16B:
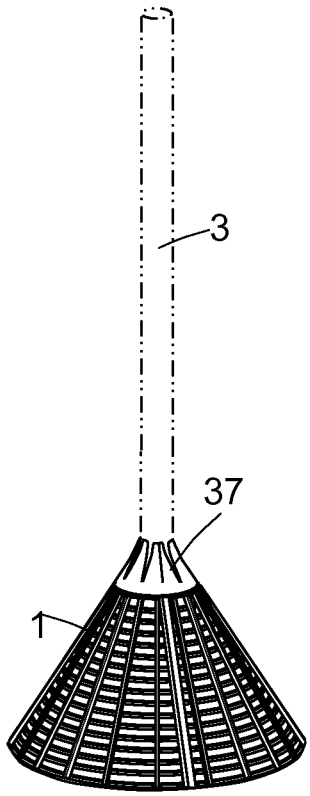
FIG. 16B shows the finished product obtained when a mostly netted sheet is used to fabricate the cone.

FIGS. 16, 16A and 16B illustrates the finished product resulting from using the method described in FIGS. 15-15C. The cone shown in FIG. 16 is made of a solid sheet that is a sheet without holes. The attachment mechanism that affixes the straw to the cone comprises the slits 36. As the straw 3 is inserted through the bottom of the cone 1, tabs 37 are separated and bent upward thus holding the straw 3 in a constricting fashion. Any attempt to slide the cone 1 up the straw 3 brings the tabs together and therefore increases friction.

FIG. 16A illustrates a cone made with a mostly solid sheet and equipped with a few number of small holes at the top. FIG. 16B shows a cone mostly made as a net. It is evident to one versed in the art that any intermediate design between a completely solid sheet and a netted sheet can be used to form a cone that holds ice down.

Figure 17:
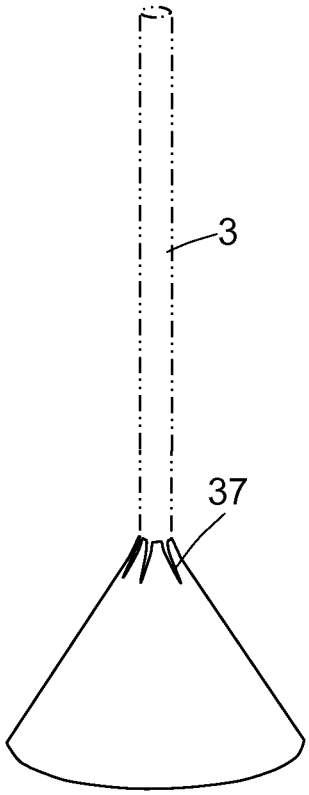
FIG. 17 shows an ice trap device made of a solid sheet and fabricated as a cone.
Figure 17A:
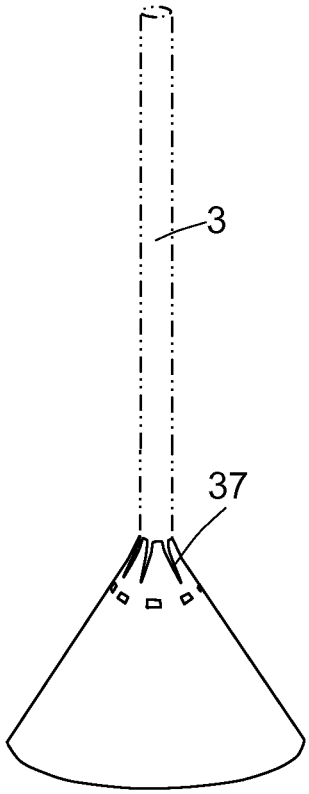
FIG. 17A shows an ice trap device made with few holes and fabricated as a cone.
Figure 17B:
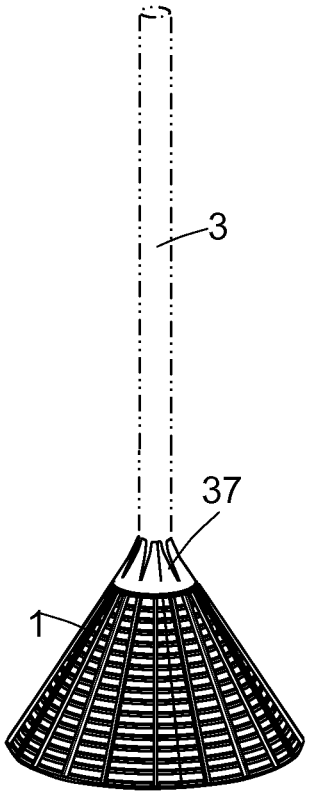
FIG. 17B shows an ice trap device made of net material and fabricated as a cone.

FIGS. 17, 17A and 17B shows the same design as FIGS. 16, 16A and 16B respectively except that they are directly fabricated as a cone rather than being assembled from a flat sheet.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A drinking apparatus for holding down ice cubes within close proximity to the bottom opening of a straw in a drinking cup, comprising:

a. a truncated cone having its base at the lower end and its apex at the top end, b. said apex being traversed by a hole through which a straw can pass, c. said apex also comprising an attachment mechanism for affixing said straw to said apex, said attachment mechanism being non-detachable from said apex, wherein said attachment mechanism comprises at least one flexible structure perforated by a hole, said hole configured to fit snugly around said straw and providing a resistive frictional force against sliding movement by said straw along the axis of said cone.

2. The drinking apparatus of claim 1 wherein said cone is made in part or in whole as a net.

3. The drinking apparatus of claim 1 wherein said cone is made of a solid sheet material.

4. The drinking apparatus of claim 1 wherein said flexible structure is a membrane.

5. The drinking apparatus of claim 1 wherein said attachment mechanism comprises at least one flexible funnel-shaped membrane coaxial with said cone, said membrane having its widest rim at the top and its narrowest rim at the bottom, furthermore, said membrane affixed at its said widest rim to said apex, said narrowest rim defining a circular opening configured to fit snugly around said straw and providing a resistive frictional force against sliding movement by said straw along the axis of said cone.

6. The drinking apparatus of claim 1 wherein said attachment mechanism comprises at least one flexible disk-shaped plate, periphery of said disk-shaped plate being affixed to said apex, said disk-shaped plate having a number of radial slits and divided into sectors, said sectors configured to bend down when said straw is pushed down through said disk-shaped plate, said sectors exerting a constricting force on said straw, thereby restricting the sliding of said straw along the axis of said cone.

7. The drinking apparatus of claim 1 wherein said attachment mechanism comprises at least one flexible disk-shaped plate, periphery of said disk-shaped plate being affixed to said apex, said disk-shaped plate having a number of radial slits and divided into sectors, said sectors configured to bend up when said straw is pushed up through said disk-shaped plate, said sectors exerting a constricting force on said straw, thereby restricting the sliding of said straw along the axis of said cone.

8. The drinking apparatus of claim 1 wherein said attachment mechanism comprises a tube made of flexible material, said tube being coaxial with said cone and having at least one narrowing along its length, said at least one narrowing configured to fit snugly around said straw, said at least one narrowing exerting a frictional force on said straw, thereby restricting the sliding of said straw along the axis of said cone.

9. The drinking apparatus of claim 1 wherein said attachment mechanism comprises a tube, said tube being coaxial with said cone, the sides of said tube being partially scored to form tabs, said tabs being pushed inward, said tabs exerting a constricting force on said straw, thereby restricting the sliding of said straw along the axis of said cone.

10. The drinking apparatus of claim 1 wherein said attachment mechanism comprises at least one truncated restraining cone, said at least one restraining cone being coaxial with said cone, a narrow opening of said at least one restraining cone forming a narrow passage configured to exert a constricting force on said straw, thereby restricting the sliding of said straw along the axis of said cone.

11. The drinking apparatus of claim 1 wherein said attachment mechanism comprises a tube coaxial with said cone, the cross-section of said tube having the shape of an ellipse, major axis of said ellipse being larger than the outer diameter of said straw and the minor axis of said ellipse being smaller than the outer diameter of said straw, said tube being made of flexible material configured to allow said cross-section to be deformed to a circular shape when said tube is squeezed along said major axis, thereby restricting the sliding of said straw along the axis of said cone when said tube is not squeezed and not restricting the sliding of said straw along the axis of said cone when said tube is squeezed.

12. The drinking apparatus of claim 11 wherein the inside surface of said tube is partially coated or fully coated with a material selected for its high coefficient of friction.

13. The drinking apparatus of claim 1 wherein said straw is permanently attached, wherein said attachment mechanism is configured to attach said straw to said apex in a permanent non-detachable fashion.

14. The drinking apparatus of claim 13 wherein said straw has the shape of a truncated cone with its largest diameter at the bottom and attached to said apex and its smallest diameter on top.

15. The drinking apparatus of claim 1 wherein said straw comprises near its lower end two annular protuberances, each said protuberance permanently attached to said straw and forming between themselves a narrow neck along said straw, and said attachment mechanism being configured with said hole in the shape of a collar, said collar being configured to fit snugly around said neck when the lower end of said straw is pushed through said collar, thereby holding said straw in place.

16. The drinking apparatus of claim 1 wherein said straw comprises near its lower end an annular protuberance, said protuberance permanently attached to said straw, and said attachment mechanism comprising a cylinder with a swelling at its waist, said swelling forming a chamber, said chamber being configured to fit snugly around said protuberance when the lower end of said straw is pushed through said cylinder, thereby holding said straw in place.

17. The drinking apparatus of claim 1 wherein said straw comprises near its lower end an annular protuberance, said protuberance permanently attached to said straw, and furthermore said straw comprising a conical flair at its lower end, said protuberance and said flair forming between themselves a narrow neck along said straw, and said attachment mechanism being configured with said hole in the shape of a collar, said collar being configured to fit snugly around said neck when the said straw is pushed up through said collar, thereby holding said straw in place.

18. A method of manufacturing said drinking apparatus of claim 1 comprising:

a. cutting a sheet into the shape of an open ring;

b. configuring the inside edge of the open ring as said straw attachment mechanism;

c. bringing together the ends of the open ring, thereby forming a truncated cone;

d. attaching together the ends of the open ring.

19. The method of claim 18 wherein said straw attachment mechanism comprises radial slits cut into inside of said open ring.

20. The drinking apparatus of claim 1 wherein said truncated cone includes an upper edge at its top, said upper edge being cut by at least two slits.

* * * * *